US006106315A

United States Patent [19]

Lalange et al.

[11] Patent Number: 6,106,315

[45] Date of Patent: Aug. 22, 2000

[54] ELECTRICAL CONNECTOR WITH SHUNT

[75] Inventors: Jacques Lalange, Pontoise; Olivier Pamart, Ecouen, both of France

[73] Assignee: The Whitaker Corporation, Wilmington, Del.

[21] Appl. No.: 09/355,830

[22] PCT Filed: Jan. 28, 1998

[86] PCT No.: PCT/IB98/00104

§ 371 Date: Aug. 5, 1999

§ 102(e) Date: Aug. 5, 1999

[87] PCT Pub. No.: WO98/35407

PCT Pub. Date: Aug. 13, 1998

[30] Foreign Application Priority Data

Feb. 11, 1997 [EP] European Pat. Off. ..... 97400300

[51] Int. Cl.[7] ..... H01R 29/00

[52] U.S. Cl. ..... 439/188; 200/51.1

[58] Field of Search ..... 439/188, 189, 439/595, 944; 200/51.1

[56] References Cited

U.S. PATENT DOCUMENTS

| | | | |
|---|---|---|---|
| 4,850,888 | 7/1989 | Denlinger et al. | 439/188 |
| 4,978,311 | 12/1990 | Oda et al. | 439/188 |
| 5,145,356 | 9/1992 | Minnis | 439/188 |
| 5,263,872 | 11/1993 | Marpoe, Jr. et al. | 439/188 |
| 5,466,168 | 11/1995 | Liebich et al. | 439/188 |
| 5,788,520 | 8/1998 | Roche | 439/188 |
| 6,039,589 | 3/2000 | LaLange et al. | 439/188 |

FOREIGN PATENT DOCUMENTS

| | | | |
|---|---|---|---|
| 0 678 938-A1 | 10/1995 | European Pat. Off. | H01R 13/436 |
| 29 03 896-C2 | 11/1990 | Germany | H01R 13/71 |
| 2 245 775 | 1/1992 | United Kingdom | H01R 13/703 |

OTHER PUBLICATIONS see PCT International Search Report for any references that are not enclosed herewith.

*Primary Examiner*—T. C. Patel

[57] ABSTRACT

An electrical connector having a shunt contact for short circuit interconnection of terminals in a housing, where during insertion of the terminal in the housing, the short circuit contact is biased away from the terminal by engagement of a housing locking lance thereagainst so that damage to the shunt contact is minimized, in particular reduced rubbing of the gold plated contact surface and reduced risk of buckling due to abutment of the contact mating end with the shunt during insertion.

10 Claims, 2 Drawing Sheets

ELECTRICAL CONNECTOR WITH SHUNT

BACKGROUND OF THE INVENTION

1. Field of the Invention

This invention relates to an electrical connector having a shunt or switching contact.

2. Summary of the Prior Art

Provision of shunt or switching contacts in electrical connectors is common for a wide range of applications. Examples of connectors with shunt terminals are disclosed in DE 29 03 896, U.S. Pat. No. 4,850,888, U.S. Pat. No. 4,978,311 and EP 678 938. There are certain applications where a particularly high reliability of the shunting contacts is required. For example, in automotive airbag or other safety systems, shunting contacts are provided for short circuiting the electrical leads connected to the detonator in order to prevent accidental ignition when connectors in the system are uncoupled (for example during maintenance). In applications where a particularly high reliability is required, it is typical to gold plate the contact surfaces between the shunting contacts and terminals. The adverse effects of corrosion deteriorating the contact surfaces is thus avoided. The gold plating layer is usually very thin in order to reduce costs. Insertion or removal of terminals in cavities of a connector housing may lead to damaging of the gold plated contact surfaces as they rub against the shunt contact.

SUMMARY OF THE INVENTION

It is an object of this invention to provide a shunt connector, with improved reliability, in particular that reduces the risk of damage to contact surfaces. It would be advantageous to provide a shunt connector that is particularly cost effective to manufacture and assemble.

Objects of this invention have been achieved by providing the connector according to claim 1. Disclosed herein is an electrical connector comprising an insulative housing, a terminal mounted in the housing, and a shunt or switching contact mounted to the housing and engaging the terminal when fully assembled in the housing, the contact and terminal having respective contact surfaces that abut each other during engagement, wherein the connector further comprises a projecting member extending into a cavity of the housing for receiving the terminal, the projecting member coupled to the shunt or switching contact during insertion of the terminal in the cavity such that the contact surface of the shunt or switching contact is biased away from the terminal. Rubbing of the shunt or switching contact with the terminal during insertion of the terminal in the housing is thus avoided. Removal and insertion of the terminal during repair is also not detrimental to the contact surfaces.

The projecting member may be provided as a portion of the housing that abuts and biases a portion of the shunt or switching contact during insertion of the terminal. The portion of the housing may be integrally formed as a single part with the housing. In an advantageous embodiment, the projecting member could also act as a locking protrusion engaging behind a locking shoulder of the terminal in the fully assembled position, the locking protrusion being provided on a resilient locking arm of the housing. For example the resilient locking lance of the housing could be in the shape of a cantilever beam extending alongside the terminal receiving cavity from an attached end to a free end, where the free end engages the shunt contact.

It would also be conceivable to provide the projecting member as a separate part moveable within the housing, or extending from the shunt or switching contact either integrally formed therewith, or overmoulded to the contact which may be a stamped and formed part from sheet metal.

In an advantageous embodiment, the contact may comprise a spring arm in the form of a cantilever beam extending from an attachment portion to a free end being engaged by the projecting member during insertion of the terminal, for biasing the contact surface of the shunt away from the terminal.

Further advantageous aspects of this invention are described in the claims, or will be apparent from the following description and drawings.

DETAILED DESCRIPTION OF THE PREFERRED EMBODIMENT

Figure 1:
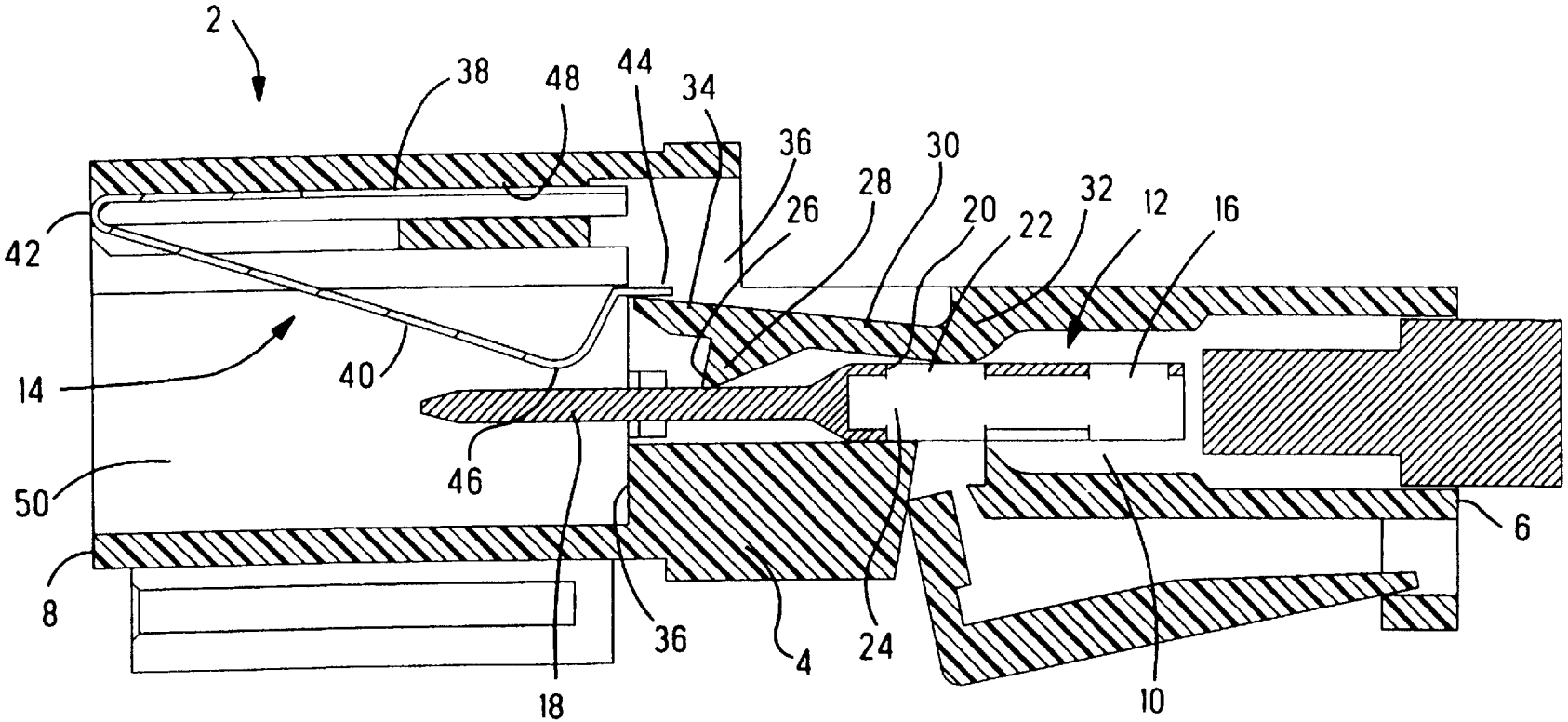
FIG. 1 is a cross-sectional view through a connector according to this invention, during insertion of a terminal in a housing of the connector.
Figure 2:
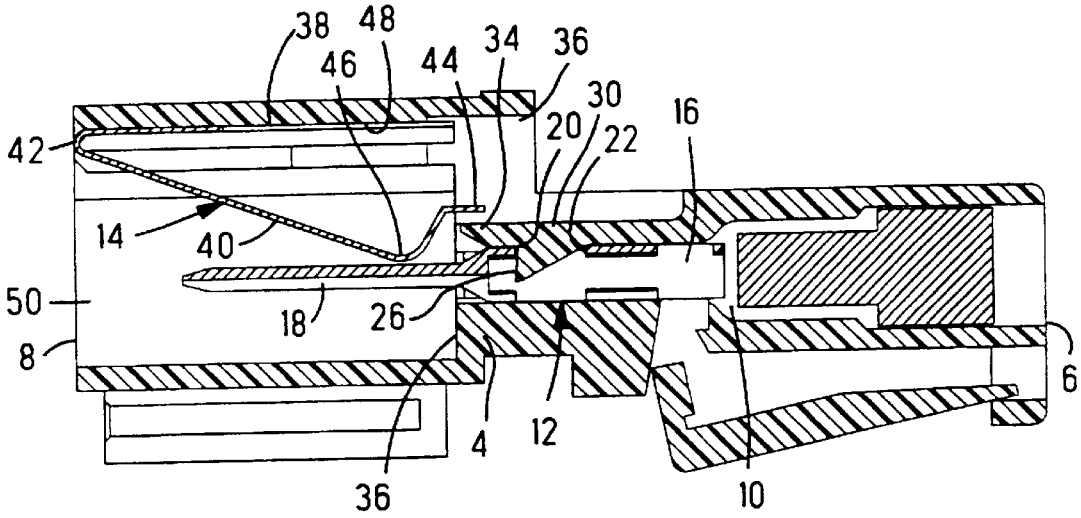
FIG. 2 is a view similar to that of FIG. 1 but with a fully inserted terminal.
Figure 3:
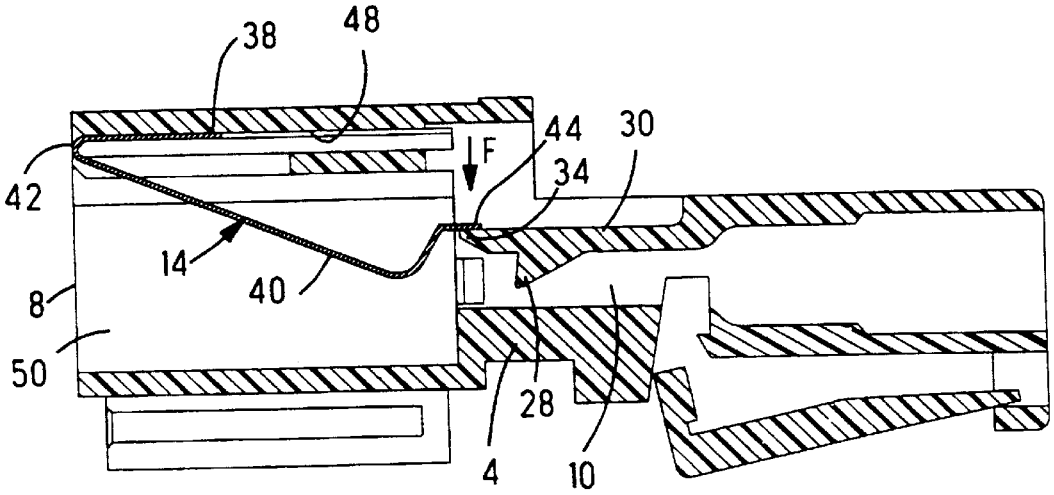
FIG. 3 is a view similar to the FIGS. 1 and 2 without the terminal.

Referring to FIGS. 1 and 2, an electrical connector 2 comprises an insulative housing 4 extending from a terminal receiving end 6 to a mating end 8 with terminal receiving cavities 10 extending therethrough for receiving terminals 12. The connector may comprise a plurality of terminal receiving cavities 10 arranged in a row each for receiving a terminal. The connector may also be provided with a plurality of rows of terminals stacked upon each other, however the invention can be described with a single terminal and receiving cavity as shown in FIGS. 1–3. The connector 2 further comprises a shunt contact 14 securely mounted to the housing 4. The shunt contact in this embodiment is for electrically interconnecting two or more of the terminals 12, but the shunt contact 14 could also contact only a single terminal 12 of the connector 2 if it functions as a switching contact where the shunt contact is connected to a conductor external to the connector.

The terminal 12 comprises a connection section 16 for connection to a conductor such as a conducting wire, and a contact section 18 for mating with a complementary terminal of a mating connector (not shown). The contact section 18 in the terminal of the present embodiment is a tab or pin terminal for mating with a receptacle terminal. The terminal 12 is provided with retention means in the form of a locking shoulder 20 provided in a cutout 22 of a body section 24 of the terminal, the body section 24 positioned intermediate the contact section and the connection section. The terminal retention means 20 engages with a complementary retention means of the housing 4, provided in the form of a locking shoulder 26 on a locking projection 28 that projects through the terminal cutout 22 once the terminal is fully inserted in the cavity 10 as shown in FIG. 2. The locking projection 28 is provided on a flexible lance 30 that is integrally formed with the housing 4. The lance 30 extends from an attachment end 32 to a free end 34 positioned proximate an inner mating face 36 of the housing. The locking projection 28 is positioned proximate the free end 34. The lance 30 is outwardly biasable within a slot 36 of the housing, where biasing of the lance occurs during insertion of the terminal 12 in the cavity 10 by abutment of the projection 28 against the terminal.

The shunt contact 14 comprises a base or mounting portion 38 and a spring arm 40 extending therefrom at an attachment end 42 to a free end 44. The shunt contact comprises a contact protrusion 46 providing an arcuate contact surface for abutment against the terminal 12, positioned proximate the free end 44. The contact protrusion 46 s resiliently biased towards the terminal by virtue of spring arm 40. The attachment portion 42 comprises a U-shaped bend interconnecting the base portion to the spring arm.

The shunt contact base portion 38 comprises retention means that may be in the form of locking projections, or barbs, or a resilient locking lance, or simply an interference fit with a cavity 48 in the housing 4 which receives the base portion 38. The base portion 38 thus serves to securely mount the shunt contact to the housing 4. The base portion 38 may also comprise an extension such that the base portion extends across two or more terminals arranged in adjacent cavities for short circuit interconnection of two or more terminals. For example a row of cavities 10 may be provided in the housing, (the row extending in a direction perpendicular to the plane of the drawings in FIGS. 1–3) where independent spring arms 40 may be connected to the base portion 38, each for contacting a different terminal.

It is also conceivable to provide the base portion 38 with a connection section for connection to a conducting wire for example, where the shunt contact connects only to one terminal and acts as a switching contact.

The shunt contact spring arm 40 extends within a cavity 50 adapted to receive a portion of a mating connector therein, the mating connector comprising means for biasing the shunt contact to disconnect the terminal from the shunt contact, as is typical with shunting functions in conventional connectors.

During insertion of the terminal 12 in the cavity 10, the shunt free end 44 is biased out of contact with the terminal by projecting means extending between the terminal and the shunt. In this embodiment, the projecting means are provided on the locking lance 30, whereby the free end 34 of the locking lance abuts against the free end 44 of the shunt contact and the locking projection 28 cams over the body of the terminal 12 as shown in FIG. 1. Upon full insertion of the terminal as shown in FIG. 2, the resilient lance 30 snaps into its locking position, thereby releasing the shunt contact which biases against the terminal, (in this embodiment the contact section 18 of the terminal). Rubbing of the shunt contact surface is thus avoided, thereby reducing the risk of damage of the contact surface. The latter is particularly important where the contact surface is gold plated (or plated with another anti-corrosion material).

Another important advantage of the invention is to enable passage of the terminal past the contact protrusion 46, which may otherwise stub or abut against the mating end of the terminal and buckle or otherwise damage the shunt contact. To avoid such problems in a conventional connector, a smooth and long tapered guiding portion extending from the free end of the shunt arm is required, which consumes space. Another advantage is to use the engagement of the projection means with the shunt contact for prestressing the shunt spring arm 40 as best shown in FIG. 3. The shunt spring arm 40 can thus be provided under stress by abutment of the free end 44 against the housing lance free end 34 such that a large contact force is provided during shunt interconnection as shown in FIG. 2.

In other embodiments, the projection member 30,34 may be provided on a separate part with respect to the main portion of the housing 4 (i.e. not integrally connected as with the lance 30 of the present embodiment) and it may not be necessary to provide the locking function integrally therewith, although the combination of the locking function and shunt separation function is particularly simple and therefore also reliable and cost-effective. For example it would be possible to attach an extension to the shunt free end 44 that abuts against the terminal and acts as the projecting member that separates the shunt contact during insertion of the terminal, such projection also being received in a recess or cavity of the terminal. Such projection may be for example integrally stamped and formed with the shunt contact, or provided as a plastic extension overmoulded over the free end 44.

We claim:

1. An electrical connector comprising an insulative housing, a terminal mounted in the housing, and a shunt or switching contact mounted to the housing and having a contact surface engaging the terminal when the terminal is fully assembled in the housing, the connector further comprises a projecting member extending into a cavity of the housing for receiving the terminal, the projecting member pushed by the terminal during insertion of the terminal in the cavity so that the projecting member is coupled to the contact such that the contact surface is biased away from the terminal.

2. The connector according to claim 1 wherein the projecting member is part of the housing.

3. The connector according to claim 2 wherein the projecting member comprises a locking protrusion having a locking shoulder engaging in a recess or cavity of the terminal defining a locking shoulder, for engagement with the projecting member locking shoulder in order to retain the terminal in the housing.

4. The according to claim 1 wherein the projecting member is provided on a resilient lance.

5. The connector according to claim 4 wherein the resilient lance is integrally formed with the housing.

6. The connector according to claim 5 wherein the resilient lance is in the shape of a cantilever beam attached at an attachment end to the housing and extending therefrom alongside the terminal receiving cavity to a free end, the resilient lance engaging the shunt or switching contact proximate the free end.

7. The connector according to claim 6 wherein the shunt or switching contact engages the projecting member in a prestressed manner prior to insertion of terminal in the cavity.

8. The connector according to claim 1 wherein the contact comprises a spring arm extending from an attachment portion to a free end, the attachment portion extending from a base portion received in a cavity of the housing, the base portion being provided with retention means for securely mounting the shunt to the housing.

9. The connector according to claim 8 wherein the contact is provided with a contact protrusion for abutment against the terminal proximate the free end.

10. The connector according to claim 9 wherein the free end of the contact engages the projecting member.

* * * * *